US005214401A

United States Patent [19]

Kimura et al.

[11] Patent Number: 5,214,401

[45] Date of Patent: May 25, 1993

[54] ELECTROMAGNETIC SWITCH

[75] Inventors: Eiichi Kimura; Koji Nara, both of Gumma, Japan

[73] Assignee: Mitsuba Electric Mfg. Co., Ltd., Kiryu, Japan

[21] Appl. No.: 850,693

[22] Filed: Mar. 11, 1992

[30] Foreign Application Priority Data

May 14, 1991 [JP] Japan ..... 3-138171

[51] Int. Cl.[5] ..... H01H 67/02

[52] U.S. Cl. ..... 335/126; 335/131

[58] Field of Search ..... 335/126, 131

[56] References Cited

U.S. PATENT DOCUMENTS 4,293,835 10/1981 Davis et al. ..... 335/126
4,637,267 1/1987 Mazzorana ..... 335/131
4,706,037 11/1987 Prouty et al. ..... 335/131

*Primary Examiner*—Lincoln Donovan
*Attorney, Agent, or Firm*—Marshall & Melhorn

[57] ABSTRACT

An electromagnetic switch suitable for controlling large electric current in starter motors or the likes comprising a rod which is actuated in a longitudinal direction by an electromagnet, a fixed contact member, and a moveable contact member carried by the rod for selective engagement with the fixed contact member by energization and deenergization of the electromagnet. The moveable contact member is allowed to rotate around an axial line perpendicular to the axial line of the rod so that the moveable contact can achieve a favorable contact even when the fixed contact member involves dimensional errors, and that the moveable contact may be easily detached from the fixed contact member even when the two contact members are partly fused together. The rotational movement of the moveable contact member can be achieved by yieldably or elastically holding the moveable contact member between a pair of convex surfaces on the rod. Alternatively, a combination of a planar holding surface and a coned disc spring interposed between the planar holding surface and the moveable contact member may be used in place of one of the convex surfaces.

13 Claims, 3 Drawing Sheets

ELECTROMAGNETIC SWITCH

TECHNICAL FIELD

The present invention relates to an electromagnetic switch, and in particular to an electromagnetic switch suitable for use in a starter motor for an internal combustion engine.

BACKGROUND OF THE INVENTION

A known electromagnetic switch for the on-off control of a starter motor for an internal combustion engine comprises an electric contact set which is actuated in synchronism with a reciprocating movement of an electromagnetic plunger for axially shifting a pinion into and out of mesh with a ring gear of an internal combustion engine.

In such an electromagnetic switch, a central rod slidably received in a stationary core is driven axially by the plunger which is magnetically attracted to the stationary core against the spring force of a return spring, and thereby moves a planar moveable contact member carried by the central rod into and out of engagement with a pair of fixed contact members to selectively establish an electroconductive path between a battery and a starter motor. To maintain the contact pressure between the movable contact member and the fixed contact members, the moveable contact member is elastically supported by the rod.

The rod is also provided with a return spring interposed between a spring holder fixedly secured to the rod and an inner surface of a casing secured to the stationary core so that the rod may be returned to the original position when the electromagnetic coil of the electromagnetic plunger is deenergized.

When there is any positional deviations between the fixed contact members, the contact pressure between the moveable contact member and the fixed contact members may become unevenly distributed, and chattering may be caused in the action of the moveable contact member in coming into contact with the fixed contact members. Conversely, if a thermal fusion takes place between the moveable contact member and the fixed contact members, a substantial amount of force may become necessary in removing the moveable contact member away from the fixed contact members. To avoid any problem associated with the difficulty in removing the moveable contact member away from the fixed contact member, the spring constant of the return spring must be increased, but this in turn necessitates the magnitude of the magnetic attraction to be increased, and this leads to a need for an over-sized electromagnetic coil.

Obviously, the present invention can be applied not only to the case where the electric contact is established by the energization of the electromagnet but also to the case where the electric contact is established by the spring force of the return spring.

BRIEF SUMMARY OF THE INVENTION

In view of such problems of the prior art, a primary object of the present invention is to provide an electromagnetic switch which can ensure a favorable contact and easy separation between the movable contact member and the fixed contact members.

These and other objects of the present invention can be accomplished by providing an electromagnetic switch, comprising: an electromagnet carried by a fixed casing; a rod guided for a longitudinal movement in the casing so as to be attracted to the electromagnet when the electromagnet is energized; a return spring for restoring the rod to an initial position when the electromagnet is deenergized; a fixed contact member fixedly secured to the casing opposite to a longitudinal end of the rod; and a moveable contact member mounted on the longitudinal end of the rod so as to be selectively brought into contact with the fixed contact member depending on an energization condition of the electromagnet; the moveable contact member being mounted on the rod via support means which accommodates some angular displacement of the moveable contact member around an axis of rotation substantially perpendicular to an axial line of the rod when the moveable contact member is engaged with and disengaged from the fixed contact member.

According to this structure, even when there is a positional deviation between the fixed contacts, the moveable contact can achieve a favorable contact with the fixed contacts. Furthermore, even when the moveable contact is thermally fused with the fixed contacts, the moveable contact can make an angular displacement as it is being pulled away from the fixed contacts, and this angular displacement facilitates the separation of the moveable contact away from the fixed contacts.

According to a preferred embodiment of the present invention, the moveable contact member may comprise an annular member slidably fitted on the longitudinal end of the rod, and the support means may comprise a pair of annular holder members both slidably fitted on the rod and holding the moveable contact member therebetween, means for retaining a first one of the annular holder members facing the fixed contact member on the rod, and spring means for urging a second one of the annular holder members toward the fixed contact member.

To allow the angular displacement of the fixed contact member, each of the annular holder members may abut the moveable contact member with an end surface thereof provided with a convex configuration. Alternatively, a Belleville washer type spring may be interposed between one of the holder members and the moveable contact plate instead of using a convex surface in the holder member.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
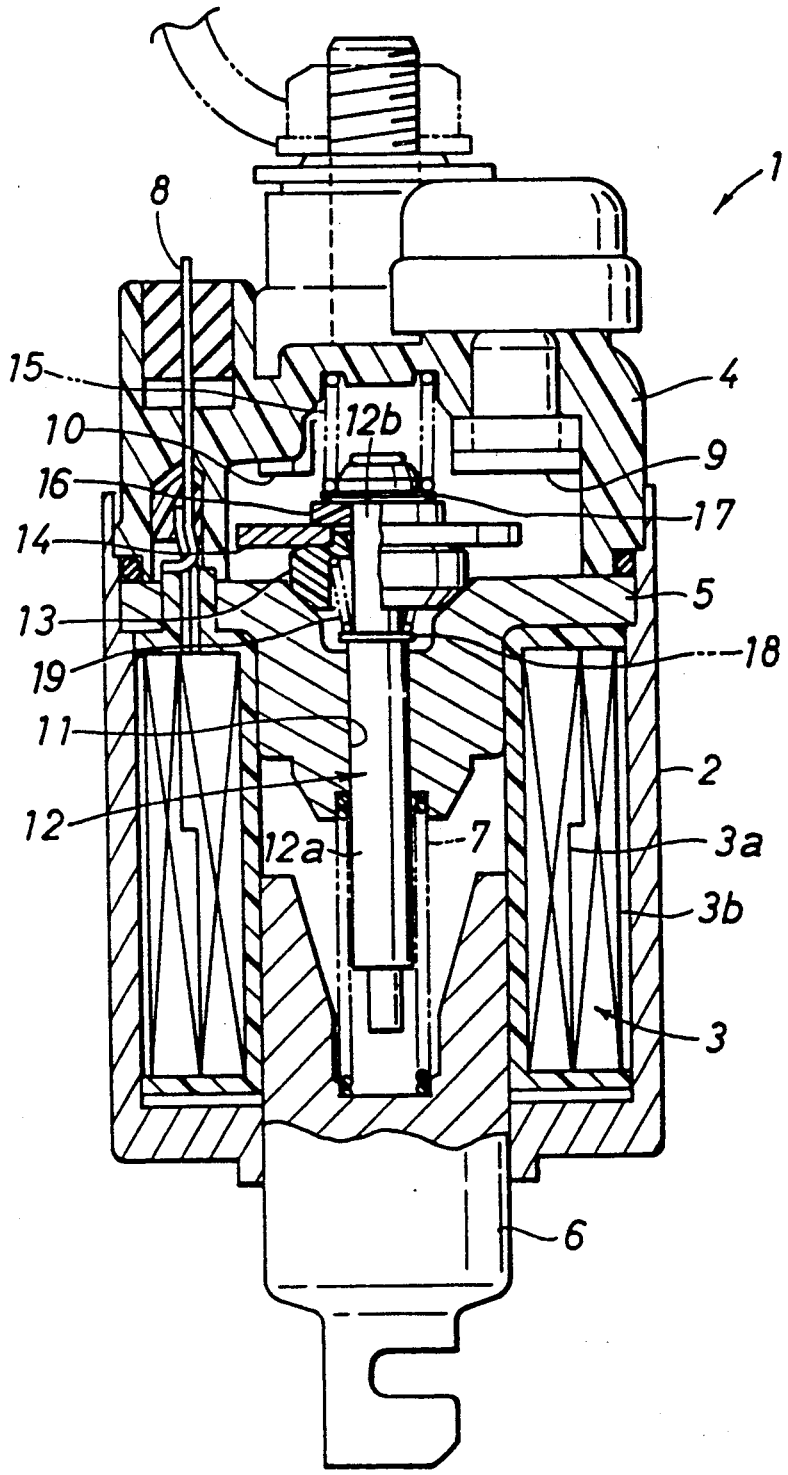
FIG. 1 is a sectional view of a first embodiment of the electromagnet for a starter motor according to the present invention.

Referring to FIG. 1 showing an embodiment of the electromagnetic switch for a starter motor according to the present invention, the electromagnetic switch 1 comprises a cylindrical yoke 2 serving also as a main part of the casing for this switch, an electromagnetic coil 3 received in the yoke 2, an end cover 4 made of synthetic resin or other electrically insulating material and closing an open end of the yoke 2, an annular stationary core 5 secured between an axial end of the coil 3 and the end cover 4 and partly received in the coil 3, and a plunger 6 which coaxially opposes a central part of the stationary core 5 and received in the electromagnetic coil 3 for axial movement so that the plunger 6 may be attracted to the stationary core 5 when the coil 3 is energized. A return spring 7 is interposed between the stationary core 5 and the plunger 6 for restoring the plunger 6 to the initial position when the coil 3 is deenergized.

The electromagnetic coil 3 consists of a pull-in coil 3*a* of a relatively thick wire, and a holding coil 3*b* of a relatively thin wire wound around the pull-in coil 3*a*. Lead wires from these coils are connected to a switch terminal 8 which extend through and out of the end cover 4. The switch terminals 8 is connected to an ignition switch which is not shown in the drawing. The other end of the holding coil 3*b* is grounded via the stationary core 5 while the other end of the pull-in coil 3*a* is connected to a fixed contact 9 which is fixedly secured to an inner wall surface of the end cover 4 and is to be electrically connected to a motor. Further, another fixed contact 10 which is to be electrically connected to a battery is mounted on the inner wall surface of the end cover 4 next to the fixed contact 9 for motor connection.

An axial guide bore 11 extends centrally through a central part of the stationary core 5, and slidably receives a switch rod 12 therein. The switch rod 12 is adapted to be pushed into the end cover 4 by being pushed at its one end by the plunger 6 when the latter is attracted to the stationary core 5. The switch rod 12 comprises a large diameter portion 12*a* slidably received in the guide bore 11 of the stationary core 5 and a small diameter portion 12*b* fitted with the moveable contact plate 14 made of electrically conducting material and other members associated therewith. More specifically, the other end of the switch rod 12 projecting from the stationary core 5 opposite to the end cover 4 is fitted into a stopper member 13, the moveable contact plate 14, and an insulator member 16 made of synthetic resin material, in that order, all moveably in the axial direction.

A holder member 17 is thermally crimped against an annular shoulder surface at an extreme end of the small diameter portion 12*b* for retaining the moveable contact plate 14 along with the insulator member 16 on the rod 12. A conical compression coil spring 19 is interposed between an end surface of the stop ring 13 facing away from the moveable contact plate 14 and a retaining ring 18 secured to an annular shoulder defined between the small and large diameter portions 12*a* and 12*b* of the rod 12. A return spring 15 is interposed between an annular shoulder of the holder member 17 and the inner wall surface of the end cover 4 for urging the switch rod 12 into the guide bore 11. A central boss 13*a* of the stopper member 13 is fitted into the central opening of the moveable contact plate 14 to ensure the electric insulation of the moveable contact 14 from the switch rod 12.

In this electromagnetic switch 1, energization of the coil causes the plunger 6 to be attracted to the stationary core 5. This movement of the plunger 6 in turn causes the switch rod 12 along with the moveable contact plate 14 to be displaced against the spring force of the return spring 15 so that the two fixed contacts 9 and 10 are electrically connected to each other by the moveable contact plate 14, and the current from the battery is supplied to the DC motor while the two end of the pull-in coil 3*a* which are connected to the fixed contacts 9 and 10, respectively, short-circuited by the moveable contact plate 14.

The elasticity of the contact spring 19 acts upon the moveable contact plate 14 in such a manner that the contact pressure of the moveable contact plate 14 upon the fixed contacts 9 and 10 is maintained at an appropriate level. When the coil 3 is deenergized, the spring forces of the two return springs 7 and 15 restore the plunger 6 and the switch rod 12 to their original positions, and the moveable contact plate 14 is moved away from the fixed contacts 9 and 10.

If the moveable contact plate 14 is allowed to move only in the longitudinal direction, a slightest positional error between the two fixed contacts 9 and 10 in the longitudinal direction would cause the pressure of the contact plate 14 upon the two fixed contacts 9 and 10 to be uneven. Further, when the moveable contact plate 14 gets attached to the fixed contact plate 14 by fusion, a significant force is necessary to remove the moveable contact plate 14 away from the fixed contacts 9 and 10 because the moveable contact is allowed to move only in the longitudinal direction, and no lever action is available in detaching the moveable contact plate 14 away from the fixed contacts 9 and 10. Therefore, the spring constant of the return spring 15 must be increased to a level sufficient for forcing the moveable contact plate 14 away from the fixed contacts even When they are attached to each other due to thermal fusion.

Figure 2:
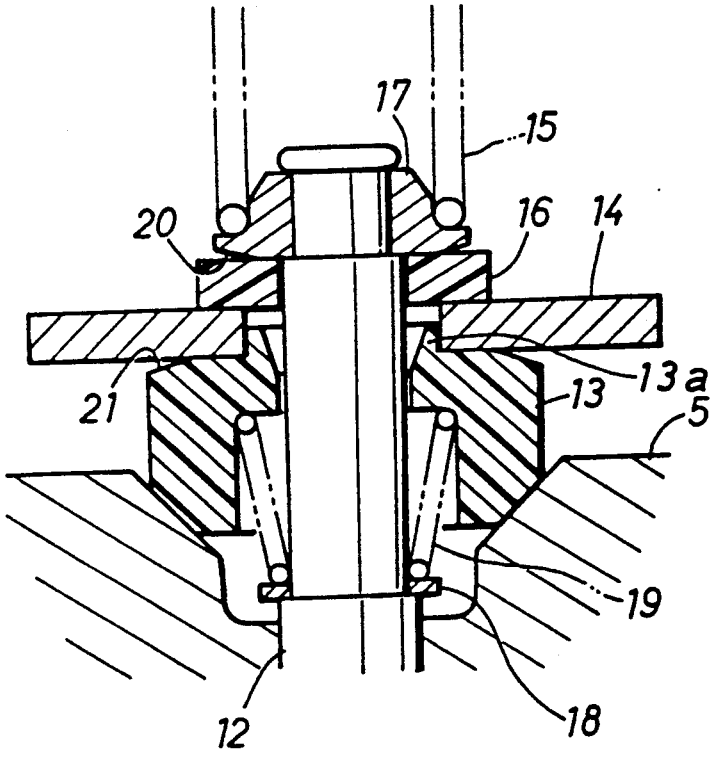
FIG. 2 is an enlarged view of a part of FIG. 1.

According to the present invention, to overcome this inconvenience, an end surface of the holder member 17 facing the moveable contact plate 14 is surrounded by a concentric conical surface 20 as illustrated in FIG. 2. Since the circular ridge defined between a planar central part of the end surface and the conical surface 20 surrounding it provides a pivotal point when the moveable contact plate 14 is angularly moved, the moveable contact plate 14 is given with a certain freedom of angular movement. For instance, when the moveable contact plate 14 is attached to one of the fixed contacts, the force of the return spring 15 moves the moveable contact plate 14 away from the other fixed contact so that the attachment between the moveable contact plate 14 and the fixed contact attached thereto can be readily broken by a lever action of the moveable contact plate 14.

Further, by providing a similar conical surface 21 to the surface of the stopper member 13 facing the moveable contact plate 14, the moveable contact plate 14 can even more readily move angularly. It should be noted that the object of the present invention can be accomplished by moving the pivotal point of the angular movement of the moveable contact plate 14 closer to the center of the switch rod 12, and it can be accomplished, for instance, by providing a small central projection defining a planar end surface. The entire end surface may be formed as a part-spherical surface or otherwise rounded surface which is substantially concentric to a central part of the end surface of the holder member 17 and/or the stopper member 13.

Figure 3:
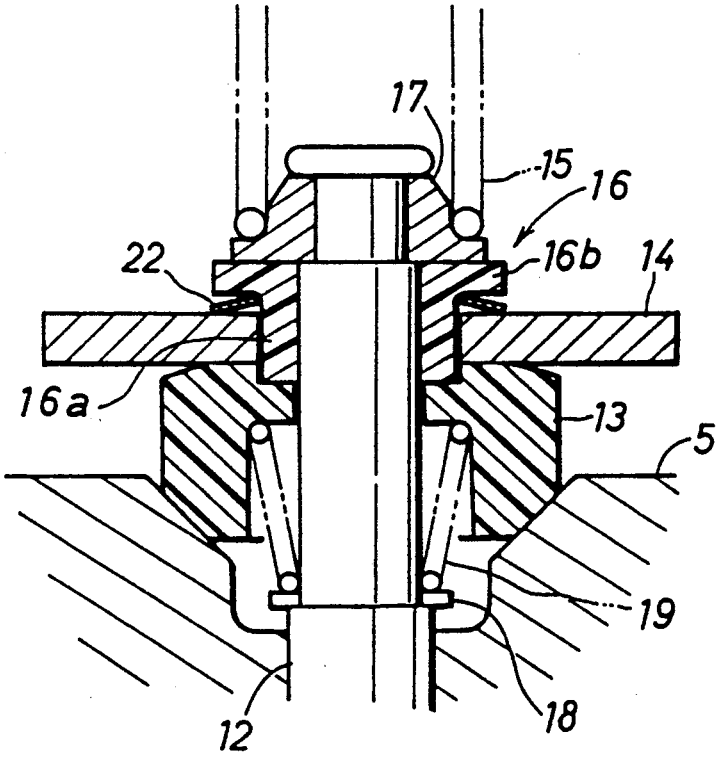
FIG. 3 is a view similar to FIG. 2 showing a second embodiment of the present invention.

In FIG. 3 showing a second embodiment of the present invention, the stopper member 13 is provided with a convex surface similar to that of the first embodiment, and the insulator member 16 is provided with a central boss 16*a* which is fitted into a central opening of the moveable contact plate 14. The insulator member 16 is further provided with a radial flange 16*b* facing the moveable contact plate 14 and defining a certain gap therebetween. A Belleville washer type spring or a coned disc spring 22 is fitted onto the central boss 16a of the insulator plate 16 and urges the insulator member 16 and the moveable contact plate 14 away from each other.

In this case also, the freedom of the moveable contact plate 14 to undergo an angular movement relative to the switch rod 12 can be obtained by the provision of the convex end surface of the stopper member 13 and the coned disc spring 22.

According to the present invention, since the moveable contact plate is allowed to be moved angularly as seen from sideways, the condition of the contact of the moveable contact plate with the fixed contacts and the capability of the moveable contact plate to move away from the fixed contacts can be both improved without increasing the spring constant of the return spring or the attractive force of the electromagnetic coil.

Although the present invention has been described in terms of preferred embodiments thereof, it is obvious to a person skilled in the art that various alterations and modifications are possible without departing from the scope of the present invention which is set forth in the appended claims.

What we claim is:

1. An electromagnetic switch comprising:

housing means;

an electromagnetic coil mounted in said housing means for selectively producing a magnetic field;

a core assembly positioned within said coil and including an axially slidable rod extending from an open end of said core assembly, said core assembly providing longitudinal movement of the rod in response to a magnetic field produced by said coil;

a first stationary contact and a second stationary contact mounted in said housing means in spaced apart relationship and proximate to the rod;

an electrically conductive moveable contact member provided with an inner surface, a center aperture for receiving the rod, and an outer surface for selectively engaging and disengaging said first and second stationary contacts to close and open electrical connection between said first and second stationary contacts;

an inner insulative support member provided with a coil spring for biasing said moveable contact member toward a closed connection when said coil is energized, said inner support member being slidably mounted on the rod for engaging the inner surface of said moveable contact member and insulating said moveable contact member from the rod and the compression spring; and an outer insulative support member provided with a retention means for retaining said moveable contact member and said inner insulative support member on the rod, and a return spring connected to said housing for biasing the moveable contact assembly towards an open connection, said outer insulative support member engaging the outer surface of said moveable contact member and insulating said moveable contact member from the rod and the return spring.

2. An electromagnetic switch comprising:

an electromagnet including a stationary core carried by a fixed casing;

a rod guided for a longitudinal movement in an annular bore defined in said stationary core so as to be moved toward said electromagnet via a moveable core when said electromagnet is energized;

a return spring for restoring said rod to an initial position when said electromagnet is de-energized;

a fixed contact member comprising a pair of laterally spaced apart segments which are fixedly secured to said casing opposite to a longitudinal end of said rod;

a first annular support member made of electrically insulating material and slidably and coaxially mounted on said rod adjacent said longitudinal end of said rod, said first annular support member being urged by spring means toward said fixed contact member;

a second annular support member made of electrically insulating material, and coaxially mounted on said rod in a facing relationship relative to said first annular support member from an end closer to said fixed contact member;

a moveable contact member consisting of an annular disk member made of electrically conductive material mounted on said rod between said first and second annular support members so as to be selectively brought into contact with said segments and establish an electric conductive path therebetween depending on an energized condition of said electromagnet, one of said annular support members being provided with a central boss which is passed into a central opening of said annular disk member so as to ensure electrical insulation of said moveable contact member from said rod and at least one of said annular support members abutting said moveable contact member with an end surface thereof provided with a convex configuration so as to accommodate angular displacement of said moveable contact around an axis of rotation substantially perpendicular to an axial line of said rod when said moveable contact member is engaged with and disengaged from said fixed contact member; and retaining means for securely restricting movement of said second annular support member toward said fixed contact member.

3. An electromagnet switch according to claim 1, wherein each of said insulative support members abuts said moveable contact member with an end surface thereof provided with a convex configuration for facilitating said angular displacement of said moveable contact member.

4. An electromagnetic switch according to claim 1, wherein each of said insulative support members abuts said moveable contact member with an end surface thereof provided with a beveled marginal surface for facilitating said angular displacement of said moveable contact member.

5. An electromagnetic switch according to claim 1, wherein one of said insulative support members abuts said moveable contact member with an end surface thereof provided with a convex configuration and the other one of said insulative support members abuts said moveable contact member via a coned disc spring for facilitating said angular displacement of said moveable contact member.

6. An electromagnetic switch according to claim 2, wherein said convex configuration consists of a central annular planar region, and a conical surface region surrounding said central annular planar region.

7. An electromagnetic switch according to claim 2, wherein said convex configuration consists of a central annular planar region, and a spherical surface region surrounding said central annular planar region.

8. An electromagnetic switch according to claim 2, wherein said convex configuration consists of a spherical surface region.

9. An electromagnetic switch according to claim 1, wherein said retention means comprises a metallic member secured to the end of the rod, and the return spring is interposed between a fixed part of said housing means and an end surface of said second support member facing said fixed contact member.

10. An electromagnetic switch according to claim 1, wherein at least one of said insulative support members is provided with a central boss fitted into the center aperture of said moveable contact member to ensure electrical insulation of said moveable contact member from said rod.

11. An electromagnetic switch according to claim 1, wherein one of said insulative support members abuts said moveable contact member with an end surface thereof provided with a beveled marginal surface and the other one of said insulative support members abuts said moveable contact member via a coned disc spring for facilitating said angular displacement of said moveable contact member.

12. An electromagnetic switch according to claim 11 wherein the coned disc spring is secured about a collar formed in said insulative support member, said collar being positioned in the center aperture of said moveable contact member.

13. An electromagnetic switch according to claim 1 wherein the compression spring is a conical compression coil spring inserted onto the rod, said compression spring having a narrow end attached to the rod and a wide end engaging the inner insulative support member.

* * * * *